US009858859B2

(12) United States Patent
Her et al.

(10) Patent No.: US 9,858,859 B2
(45) Date of Patent: Jan. 2, 2018

(54) DISPLAY DEVICE AND DRIVING METHOD THEREOF

(71) Applicant: SAMSUNG DISPLAY CO., LTD., Yongin-si, Gyeonggi-Do (KR)

(72) Inventors: Yong-koo Her, Yongin-si (KR); Mukyung Jeon, Ulsan (KR); Jihye Lee, Yongin-si (KR)

(73) Assignee: SAMSUNG DISPLAY CO., LTD., Yongin-Si, Gyeonggi-do (KR)

( * ) Notice: Subject to any disclaimer, the term of this patent is extended or adjusted under 35 U.S.C. 154(b) by 0 days.

(21) Appl. No.: 14/964,604

(22) Filed: Dec. 10, 2015

(65) Prior Publication Data

US 2016/0284272 A1 Sep. 29, 2016

(30) Foreign Application Priority Data

Mar. 23, 2015 (KR) ..... 10-2015-0040277

(51) Int. Cl.
*G09G 3/32* (2016.01)
*G09G 3/3233* (2016.01)

(52) U.S. Cl.
CPC ... *G09G 3/3233* (2013.01); *G09G 2310/0297* (2013.01); *G09G 2320/029* (2013.01); *G09G 2320/0233* (2013.01); *G09G 2380/02* (2013.01)

(58) Field of Classification Search
CPC .. G09G 3/3241; G09G 3/3233; G09G 3/3258; G09G 3/3291; G09G 2320/0233; G09G 2310/0297; G09G 2300/0426; G09G 2320/029; G09G 2380/02; G09G 2320/045; G09G 2320/08
See application file for complete search history.

(56) References Cited

U.S. PATENT DOCUMENTS

2008/0218450 A1* 9/2008 Park ..... G09G 3/3233 345/76
2010/0231810 A1 9/2010 Itoh
2011/0273372 A1 11/2011 Aliaj
2013/0215041 A1* 8/2013 Kim ..... G06F 3/0487 345/173
2015/0022515 A1* 1/2015 Ikeda ..... G09G 3/3275 345/212

FOREIGN PATENT DOCUMENTS

JP 2006-011058 A 1/2006
KR 10-2006-0112995 A 11/2006
KR 10-2008-0048324 A 6/2008
KR 10-2012-0002084 A 1/2012

* cited by examiner

*Primary Examiner* — Patrick Edouard
*Assistant Examiner* — Maheen Javed
(74) *Attorney, Agent, or Firm* — Lee & Morse, P.C.

(57) ABSTRACT

A display device includes a display panel, a light emission control driver, and a brightness compensator. The display panel includes first pixels in a first display area and second pixels in a second display area. The light emission control driver controls light emission times of the first and second pixels. The brightness compensator detects a degree of deterioration of the first pixels and a degree of deterioration of the second pixels. The degrees of deterioration of the first and second pixels are different. The brightness compensator controls the light emission control driver to set the light emission times of the first pixels differently from the light emission times of the second pixels based on the different degrees of deterioration of the first and second pixels.

19 Claims, 6 Drawing Sheets

DISPLAY DEVICE AND DRIVING METHOD THEREOF

CROSS-REFERENCE TO RELATED APPLICATION

Korean Patent Application No. 10-2015-0040277, filed on Mar. 23, 2015, and entitled, "Display Device and Driving Method Thereof," is incorporated by reference herein in its entirety.

BACKGROUND

1. Field

One or more embodiments described herein relate to a display device and a method for driving a display device.

2. Description of the Related Art

A flexible display panel may be folded by a user. Such a panel may include an organic light emitting display device which has excellent brightness, lower power consumption, fast response speed, a wide viewing angle, and does not require an additional light source, e.g., a backlight. An organic light emitting display device is also thin and light-weight and therefore suitable for use in a flexible display panel.

The display area of the panel may include first and second display areas. When unfolded, images are displayed on the entire display area. When folded, images may be displayed on only the first display area.

Organic light emission devices in the first display area may deteriorate more quickly than those in the second display area. This is because the organic light emission devices in the first display area are used for a longer period of time, e.g., when the panel is both in folded and unfolded. Because the organic light emission devices deteriorate at different rates in the first and second display areas, images displayed on the entire display area when the panel is unfolded may have different brightness in the first and second display areas. Display quality may therefore be adversely affected.

SUMMARY

In accordance with one or more embodiments, a display device includes a display panel including first pixels in a first display area and second pixels in a second display area; a light emission control driver to control light emission times of the first and second pixels; and a brightness compensator to detect a degree of deterioration of the first pixels and a degree of deterioration of the second pixels, wherein the degree of deterioration of the first pixels is different from the degree of deterioration of the second pixels, and wherein the brightness compensator is to control the light emission control driver to set the light emission times of the first pixels to be different from the light emission times of the second pixels based on the different degrees of deterioration of the first and second pixels.

A folding axis may extend between the first and second display areas, and the display panel may fold and unfold relative to the folding axis. An image may be displayed in one of the first or second display areas when the display panel is folded, and an image may be displayed on both of the first and second display areas when the display panel is unfolded.

The display device may include a plurality of scan lines extending in a first direction and connected to the first and second pixels, the scan lines to receive scan signals; a plurality of data lines extending in a second direction intersecting the first direction and connected to the first and second pixels, the data lines to receive data voltages and detection currents; a plurality of first light emission lines extending in the first direction and connected to the first pixels, the first light emission lines to receive first light emission signals from the light emission control driver; a plurality of second light emission lines extending in the first direction and connected to the second pixels, the second light emission lines to receive second light emission signals from the light emission control driver; and a plurality of detection lines extending in the second direction and connected to the first and second pixels, the detection lines to receive detection signals.

The first light emission lines may be in the first display area and extend adjacent to the folding axis, and the second light emission lines may be in the second display area and extend adjacent to the folding axis. The display device may include a scan driver to output the scan signals; a data driver to output the data voltages during a driving period; and a switching circuit to connect the brightness compensator to the data lines during a detection period and to connect the data lines to the data driver during the driving period.

The light emission control driver may include a first light emission control driver to output the first light emission signals; and a second light emission control driver to output the second light emission signals. During a detection period, the brightness compensator may provide the detection currents to the first and second pixels and to detect the degrees of deterioration in the first and second pixels based on the detection currents; during a driving period, the first and second pixels may charge the data voltages based on the scan signals; and during a light emission period, the first and second pixels may generate light corresponding to the data voltages based on the first and second light emission signals.

The brightness compensator may control the first light emission control driver to adjust the applying times of the first light emission signals based on the degree of deterioration the first pixels, and control the second light emission control driver to adjust the applying times of the second light emission signals based on the degree of deterioration of the second pixels. The applying times of the first and second light emission signals may be adjusted to set the light emission times of the first pixels to be longer than the light emission times of the second pixels. The first and second pixels may emit light during times that correspond to the applying times of the first and second light emission signals. Each of the first and second pixels may include a light emitter to generate light based on a corresponding one of the data voltages.

The brightness compensator may include a first sensing circuit to provide the detection currents to the first pixels during a detection period, detect one or more voltages applied to light emission devices of the first pixels based on the detection currents, and output the one or more detected voltages as first deterioration information; a second sensing circuit to provide the detection currents to the second pixels during a detection period, detect one or more voltages applied to light emission devices of the second pixels based on the detection currents, and output the one or more detected voltages as second deterioration information; and a light emission signal compensator to output a first control signal corresponding to the first deterioration information and a second control signal corresponding to the second deterioration information.

The first light emission control driver may adjust and output an applying time of the first light emission signal based on the first control signal, and the second light emission control driver may adjust and output an applying time of the second light emission signal based on the second control signal. The display panel may be a flexible display panel.

In accordance with one or more other embodiments, a driving method of a display device includes applying detection currents to light emission devices of first pixels in a first display area of a display panel and to light emission devices of second pixels in a second display area of the display panel; detecting different degrees of deterioration of the first pixels and the second pixels based on the detection currents; and adjusting light emission times of the first pixels based on the degree of deterioration of the first pixels and the light emission times of the second pixels based on degree of deterioration of the second pixels, the first and second pixels to emit light according to the adjusted light emission times, light emission times of the first pixels and light emission times of the second pixels adjusted differently based on the different degrees of deterioration of the first and second pixels.

The degree of deterioration of the first pixels may be greater than the degree of deterioration of the second pixels, and the light emission times of the first pixels may be longer than the light emission times of the second pixels. Detecting the degrees of deterioration of the first and second pixels may include detecting one or more voltages applied to light emitters of the first pixels based on the detection currents and outputting the one or more detected voltages as first deterioration information; detecting one or more voltages applied to light emitters of the second pixels based on the detection currents, and outputting the one or more detected voltages as second deterioration information; and adjusting applying times of first light emission signals for the first pixels based on the first deterioration information and applying times of the second light emission signals for the second pixels based on the second deterioration information.

The first and second pixels may generate light corresponding to data voltages received in response to scan signals and emit light during times corresponding to the applying times of the first and second light emission signals. The display panel may be a flexible display panel; a folding axis may be between the first and second display areas; images may be displayed in one of the first or second display area when the display panel is folded; and images may be displayed in both of the first and second display areas when the display panel is unfolded.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
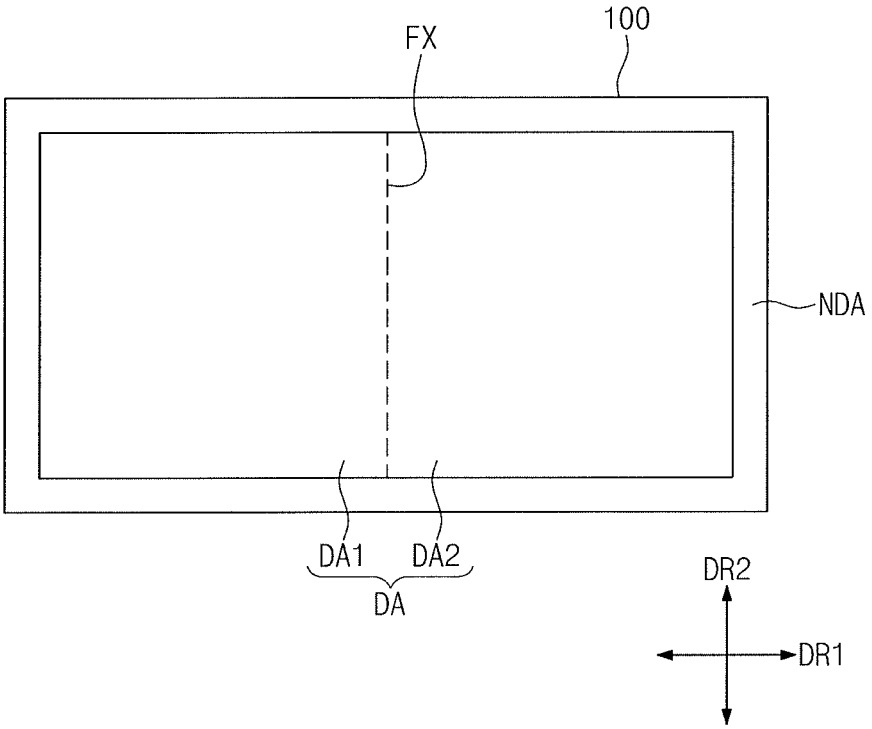
FIG. 1 illustrates an embodiment of a display panel.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments.

It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

Figure 2:
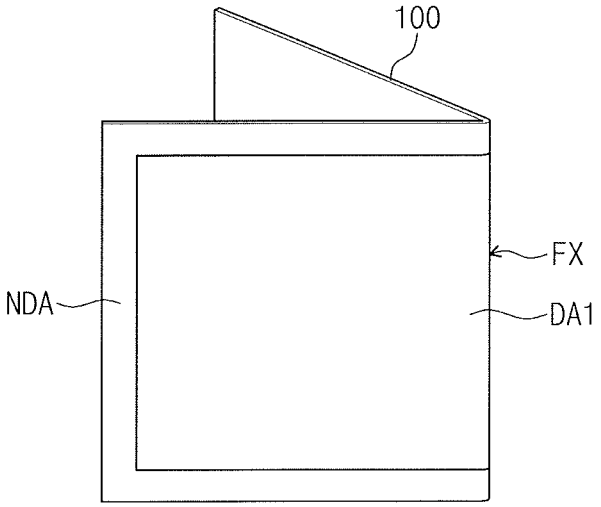
FIG. 2 illustrates an example of the display panel when folded.

FIG. 1 illustrates an embodiment of a display panel 100 of a display device, and FIG. 2 illustrates an example of the display panel when folded. Referring to FIGS. 1 and 2, the display device includes a display panel 100. The display panel 100 may be a flexible display panel which may fold, curve, or otherwise flex. The display panel 100 has a long side in a first direction DR1 and a short side in a second direction DR2 intersecting the first direction DR1.

The display panel 100 includes a display area DA and a non-display area NDA around the display area DA. The display area DA includes a plurality of pixels for displaying images. The non-display area NDA includes one or more driving units for driving the pixels.

The display panel 100 may be folded or unfolded relative to a folding axis FX (illustrated as a virtual dotted line), which extends in a predetermined direction. In this case, in accordance with one embodiment, the display device may be a folding display device. Also, in this embodiment, the folding axis FX is at the center part of the display panel 100 and extends in the second direction DR2. The folding axis FX may be at another location in another embodiment. Also, in another embodiment, the display panel 100 may have a plurality of axes extending in the same or different directions.

In the present embodiment, the display area DA includes a first display area DA1 and a second display area DA2 divided by the folding axis FX. The first display area DA1 is left of the folding axis FA and the second display area DA2 is right of the folding axis FA. As shown in FIG. 1, when the display panel 100 is unfolded, images are displayed in the display area DA. As shown in FIG. 2, when the display panel 100 is folded along the folding axis FX, images are displayed in only one of the first display area DA1 or the second display area DA2.

Figure 3:
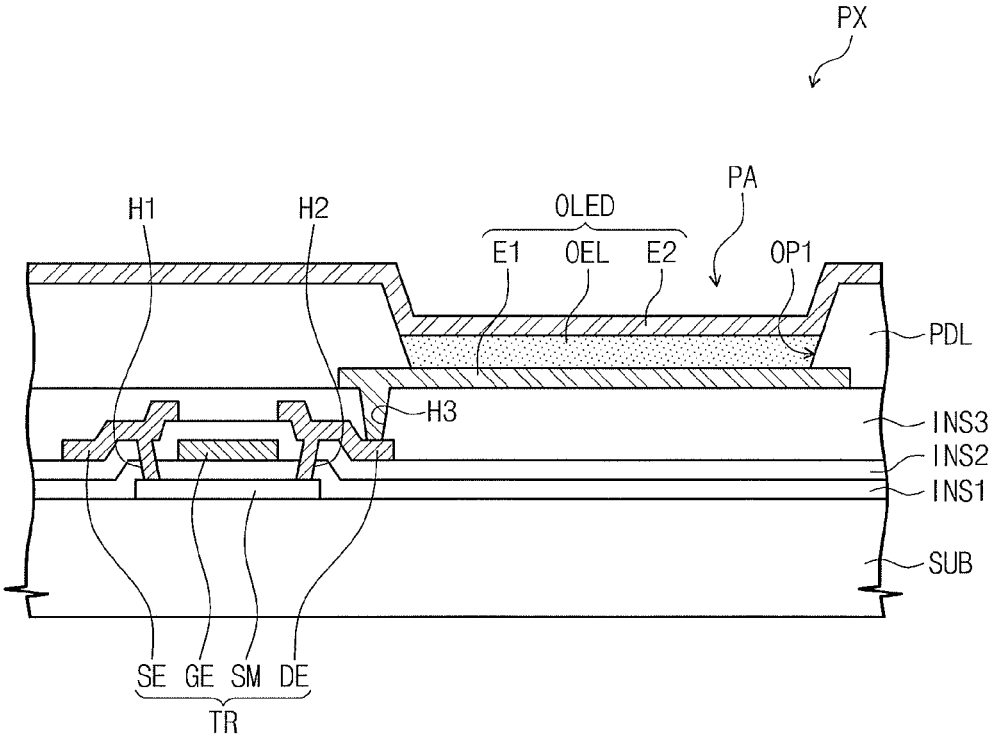
FIG. 3 illustrates an embodiment of pixel in the display panel.

FIG. 3 illustrates an example of a pixel PX that is representative of the pixels in the display area of the display panel 100. The pixel PX includes a transistor TR connected to a light emitting device. The light emitting device may be, for example, an organic light emission device OLED or another type of device.

Referring to FIG. 3, the transistor is disposed on a substrate SUB. The substrate SUB may be a transparent flexible substrate made, for example, of plastic. The substrate SUB is a flexible substrate that allows the display panel 100 to flex.

A semiconductor layer SM of the transistor TR is on the substrate SUB. The semiconductor layer SM may include a semiconductor of an inorganic material such as amorphous silicon, polysilicon, or an organic semiconductor material. Alternatively or additionally, the semiconductor layer SM may include an oxide semiconductor material. The semiconductor layer SM includes a channel area between source and drain areas.

A first insulation layer INS1 is on the substrate SUB to cover the semiconductor layer SM. The first insulation layer INS1 may include, for example, an inorganic insulation layer including an inorganic material.

A gate electrode GE of the transistor TR overlaps the semiconductor layer SM and is disposed on the first insulation layer INS1. The gate electrode GE may overlap the channel area of the semiconductor layer SM.

A second insulation layer INS2 is on the first insulation layer INS1 to cover the gate electrode GE. The second insulation layer INS2 may be an interlayer insulation layer, and may include an inorganic insulation layer including an inorganic material.

A source electrode SE and a drain electrode DE of the transistor TR are spaced from each other on the second insulation layer INS2. The source electrode SE may be connected to the source area of the semiconductor layer SM through a first contact hole H1 penetrating the first insulation layer INS1 and the second insulation layer INS2. The drain electrode DE may be connected to the drain area of the semiconductor layer SM through a second contact hole H2 penetrating the first insulation layer INS1 and the second insulation layer INS2.

A third insulation layer INS3 is on the second insulation layer INS2 to cover the source electrode SE and the drain electrode DE of the transistor TR. The third insulation layer INS3 may include an organic insulation layer including an organic material.

A first electrode E1 of the light emission device OLED is on the third insulation layer INS3. The first electrode E1 may be connected to the drain electrode DE of the transistor TR through a third contact hole 113 penetrating the third insulation layer INS3. The first electrode E1 may be defined as a pixel electrode or an anode electrode. The first electrode E1 may include a transparent electrode or a reflective-type electrode.

A pixel definition layer PDL exposes a predetermined area of the first electrode E1 and is disposed on the first electrode E1 and the third insulation layer INS3. The pixel definition layer PDL includes an open part OP1 exposing a predetermined area of the first electrode E1. An area where the open part OP1 is defined is a pixel area PA.

An organic light emitting layer OEL is on the first electrode E1 in the open part OP1. The organic light emitting layer OEL includes an organic material for generating light, e.g., red, green, blue, or white light. In one embodiment, the organic light emitting layer OEL may generate white light based on a combination of light emitted from organic materials that generate red, green, and blue light.

The organic light emitting layer OEL may include, for example, a low molecular weight organic material or a polymer organic material. The organic light emitting layer OEL may be a multi-layer including a Hole Injection Layer (HIL), a Hole Transporting Layer (HTL), an Emission Layer (EML), an Electron Transporting Layer (ETL), and an Electron Injection Layer (EIL). The HIL may be on the first electrode E1, and the HTL, EML, ETL, and EIL may be sequentially stacked on the HIL.

A second electrode E2 is on the pixel definition layer PDL and the organic light emitting layer OEL. The second electrode E2 may be defined as a common electrode or a cathode electrode. The second electrode E2 may include a transparent electrode or a reflective-type electrode.

The display panel 100 may be a front-emission-type organic light emitting display panel. In this case, the first electrode E1 may be a reflective-type electrode and the second electrode E2 may be a transparent electrode. In another embodiment, the display panel 100 may be a rear-emission-type organic light emitting display panel. In this case, the first electrode E1 may be a transparent electrode and the second electrode E2 may be a reflective-type electrode.

The light emission device OLED may be in the pixel area PA, which includes the first electrode E1, the organic light emitting layer OEL, and the second electrode E2. The first electrode E1 may be a positive electrode (e.g., a hole injection electrode) and the second electrode E2 may be a negative electrode (e.g., an electron injection electrode).

A first power voltage, for allowing the organic light emitting layer OEL of the light emission device OLED to emit light, is applied to the first electrode E1. A second power voltage, having an opposite polarity to a driving voltage, is applied to the second electrode E2 through the transistor TR. In operation, excitons are formed as holes and electrons injected to the organic light emitting layer OEL are combined. When the state of the excitons decays to a bottom state, the light emission device OLED emits light. The light emission device OLED emit, for example, red, green, and/or blue light according to a flow of current that corresponds to received image information.

Figure 4:
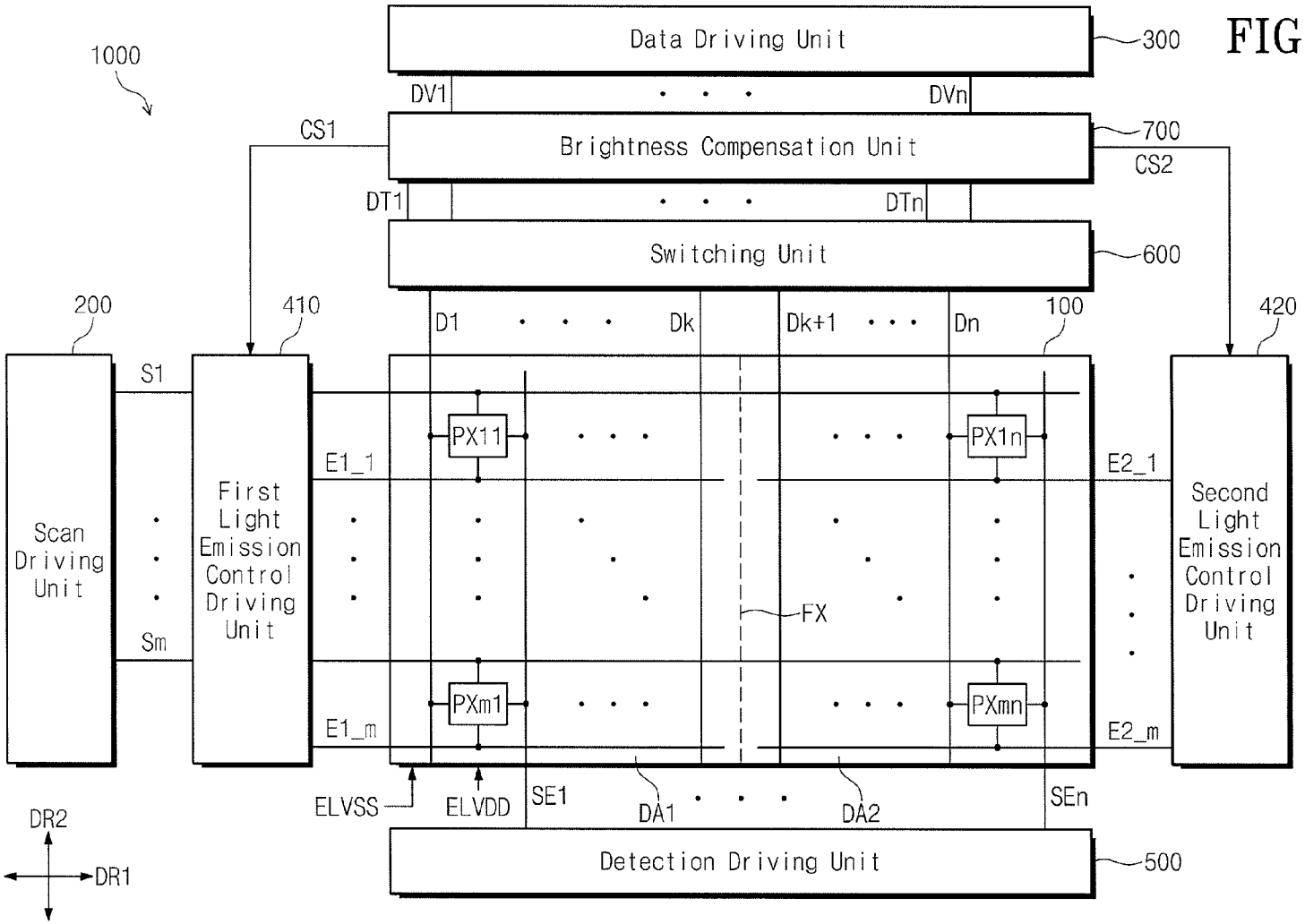
FIG. 4 illustrates an embodiment of a display device.

FIG. 4 illustrates an embodiment of a display device 1000 which includes the display panel 100, a scan driving unit 200, a data driving unit 300, light emission control driving units 410 and 420, a detection driving unit 500, a switching unit 600, and a brightness compensation unit 700.

In this embodiment, the display panel 100 includes a plurality of pixels PX11 to PXmn arranged in a matrix, a plurality of scan lines S1 to Sm, a plurality of light emission lines E1_1 to E1_m and E2_1 to E2_m, a plurality of data lines D1 to Dn, and a plurality of detection lines SE1 to SEn. The pixels PX11 to PXmn are connected to the scan lines S1 to Sm, the light emission lines E1_1 to E1_m and E2_1 to E2_m, the data lines D1 to Dn, and the detection lines SE1 to SEn. The pixels PX11 to PXmn include first pixels in a first display area DA1 and second pixels in a second display area DA2.

The scan lines S1 to Sm extend in a first direction DR1 and are connected to the scan driving unit 200. The scan lines S1 to Sm receive scan signals from the scan driving unit 200.

The light emission lines E1_1 to E1_m and E2_1 to E2_m receive light emission signals. The light emission lines E1_1 to E1_m and E2_1 to E2_m include a plurality of first light emission lines E1_1 to E1_m and a plurality of second light emission lines E2_1 to E2_m.

The light emission control driving units 410 and 420 include a first light emission control driving unit 410 for controlling a light emission time of the first pixels and a second light emission control driving unit 420 for controlling a light emission time of the second pixels. The first light emission control driving unit 410 and the second light emission control driving unit 420 face each other when the display panel 100 is folded in the first direction DR1 relative to the folding axis.

The first light emission lines E1_1 to E1_m extend in the first direction DR1 and are connected to the first light emission control driving unit 410. The first light emission lines E1_1 to E1_m are in the first display area DA1 and extend to be adjacent to the folding axis FX. The first light emission lines E1_1 to E1_m receive first light emission signals for controlling a light emission time of the first pixels based on the light emission signals from the first light emission control driving unit 410.

The second light emission lines E2_1 to E2_m extend in the first direction DR1 and are connected to the second light emission control driving unit 420. The second light emission lines E2_1 to E2_m are in the second display area DA2 and extend to be adjacent to the folding axis FX. The second light emission lines E2_1 to E2_m receive second light emission signals for controlling a light emission time of second pixels based on the light emission signals from the second light emission control driving unit 420.

The data lines D1 to Dn extend in a second direction DR2 and are connected to the data driving unit 300. The data lines D1 to Dn receive data voltages from the data driving unit 300. The data lines D1 to Dn include first data lines D1 to Dk connected to pixels in the first display area DA1 and second data lines Dk+1 to Dn connected to pixels in the second display area DA2.

The detection lines SE1 to SEn extend in the second direction DR2 and are connected to the detection driving unit 500. The detection lines SE1 to SEn receive detection signals from the detection driving unit 500.

The display device 1000 may include a timing controller for controlling operations of the scan driving unit 200, the data driving unit 300, the first light emission control driving unit 410, the second light emission control driving unit 420, the detection driving unit 500, the switching unit 600, and the brightness compensation unit 700.

The scan driving unit 200 may be at one side of the display panel 100 in the first direction DR1. The scan driving unit 200 generates and outputs scan signals. The scan signals may be output sequentially. The scan signals are provided to the pixels PX11 to PXnm through the scan lines S1 to Sm. The scan signals are provided to the pixels PX11 to PXnm during a driving period.

The data driving unit 300 are at one side of the display panel 100 in the second direction DR2. The data driving unit 300 generates and outputs data voltages.

When the display device 1000 is folded, images are displayed on only one of the first or second display areas DA1 and DA2. In this case, the data driving unit 300 provides data voltages to pixels in only the one display area.

During a driving period, the switching unit 600 connects the data driving unit 300 to the data lines D1 to Dn. For example, a plurality of driving lines DV1 to DVn are connected to the data driving unit 300 and to the data lines D1 to Dn through the switching unit 600. A brightness compensation unit 700 may be connected between the data driving unit 300 and the data lines. D1 to Dn. Data voltages are provided to the pixels PX11 to PXnm through the driving lines DV1 to DVn and the data lines D1 to Dn.

The first light emission control driving unit 410 generates and outputs first light emission signal to the first pixels through the first light emission lines E1_1 to E1_m. The second light emission control driving unit 420 generates and outputs second light emission signals to the second pixels through the second light emission lines E2_1 to E2_m.

The pixels PX11 to PXnm receive data voltages in response to scan signals during a driving period. The data voltages are charged to the pixels PX11 to PXnm. The pixels PX11 to PXnm generate the light corresponding to data voltages in response to first and second light emission signals during a light emission period. As a result, an image is displayed.

The first pixels generate light corresponding to data voltages in response to first light emission signals. The second pixels generate light corresponding to data voltages in response to second light emission signals.

The detection driving unit 500 may be disposed, for example, at the other side of the display panel 100 in the second direction DR2. The detection driving unit 500 generates and outputs detection signals. The detection signals are provided to the pixels PX11 to PXnm through the detection lines SE1 to SEn. The detection signals are provided to the pixels PX11 to PXnm during a detection period.

The brightness compensation unit 700 is at one side of the display panel 100 in the second direction DR2. The brightness compensation unit 700 controls the first and second light emission control driving units 410 and 420 according to the degree of deterioration in the first and second pixels. The brightness compensation unit 700 sets the light emission times of the first and second pixels differently based on the different degrees of deterioration of the first and second pixels.

For example, the brightness compensation unit 700 generates and outputs detection currents. During a detection period, the switching unit 600 connects the brightness compensation unit 700 to the data lines D1 to Dn. For example, a plurality of detection lines DT1 to DTn connected to the brightness compensation unit 700 are connected to the data lines D1 to Dn through the switching unit 600. Detection currents are provided to the pixels PX11 to PXnm through the detection lines DT1 to DTn and the data lines D1 to Dn, which are connected to each other.

The pixels PX11 to PXnm receive detection currents in response to detection signals. The detection currents are provided to the pixels PX11 to PXnm. Based on the detection currents, voltages applied to the pixels PX11 to PXmn are provided as deterioration information to the brightness compensation unit 700.

Deterioration information of first pixels is provided as first deterioration information to the brightness compensation unit 700. Deterioration information of second pixels is provided as second deterioration information to the brightness compensation unit 700.

The brightness compensation unit 700 provides a first control signal CS1 for adjusting an applying time of a first light emission signal to the first light emission control driving unit 410 based on the first deterioration information of the first pixels. The brightness compensation unit 700 provides a second control signal CS2 for adjusting an applying time of a second light emission signal to the second light emission control driving unit 420 based on the second deterioration information of the second pixels.

The first light emission control driving unit 410 adjusts and outputs the applying time of the first light emission signal in response to the first control signal CS1. The second light emission control driving unit 420 adjusts and outputs the applying time of the second light emission signal in response to the second control signal CS2.

As the use time of the pixels PX11 to PXmn becomes longer, the degree of deterioration of the pixels PX11 to PXmn becomes greater. Deterioration of the pixels PX11 to PXmn may be defined, for example, as the deterioration state of light emission devices in the pixels PX11 to PXmn.

As the degree of deterioration in light emission devices becomes greater, the brightness of the light generated from the light emission devices deteriorates. For example, as the degree of deterioration in the pixels PX11 to PXmn becomes greater, the brightness of the pixels PX11 to PXmn deteriorates.

For example, when the display device 1000 is folded, images may be displayed in the first display area DA1 but not in (or to a lesser extent than, e.g, in only a portion of) the second display area DA2. Accordingly, first pixels in the first display area DA1 may deteriorate at a faster rate than the second pixels in the second display area DA2. As a result, the brightness of the first pixels may be deteriorate at a faster rate than the brightness of the second pixels.

According to one embodiment, the applying time of the first and second light emission signals is adjusted to allow the light emission time of pixels having a greater degree of deterioration among the first and second pixels to be longer than a light emission time having a lesser degree of deterioration.

For example, when the first pixels have deteriorated to a greater degree than the second pixels, the applying time of the first light emission signals for the first pixels is adjusted to be longer than the applying time of the second light emission signals for the second pixels. In this case, the first and second pixels emit light during a time corresponding to the applying time of the first and second light emission signals. The brightness of the first and second pixels is proportional to a light emission time.

Accordingly, the light emission time of the first pixels having a greater degree of deterioration is set to be longer than the light emission time of the second pixels. As a result, when the display device 1000 is unfolded, the difference between the brightness of the first display area DA1 and the brightness of the second display area DA2 may not be recognized, to thereby achieve improved brightness uniformity.

Figure 5:
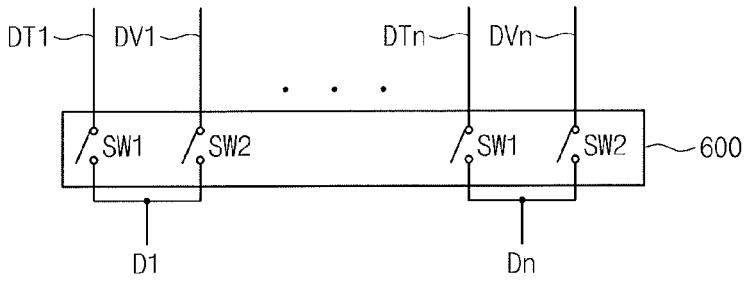
FIG. 5 illustrates an embodiment of a switching unit.

FIG. 5 illustrates an embodiment of the switching unit 600 in FIG. 4. Referring to FIG. 5, the switching unit 600 includes a plurality of first switches SW1 and a plurality of second switches SW2. One end of each of the first switches SW1 is connected to a corresponding one of the detection lines DT1 to DTn, and the other end of each of the first switches SW1 is connected to a corresponding one of the data lines DL1 to DLn. One end of each of the second switches SW2 is connected to a corresponding one of the driving lines DV1 to DVn, and the other end of each of the second switches SW2 is connected to a corresponding one of the data lines DL1 to DLn.

During a detection period, the first switches SW1 are turned on and connect the detection lines DT1 to DTn to the data lines DL1 to DLn. During a driving period, the second switches SW2 are turned on and connect the driving lines DV1 to DVn to the data lines DL1 to DLn. The first and second switches SW1 and SW2 may be turned on by a low level of switching signals.

Figure 6:
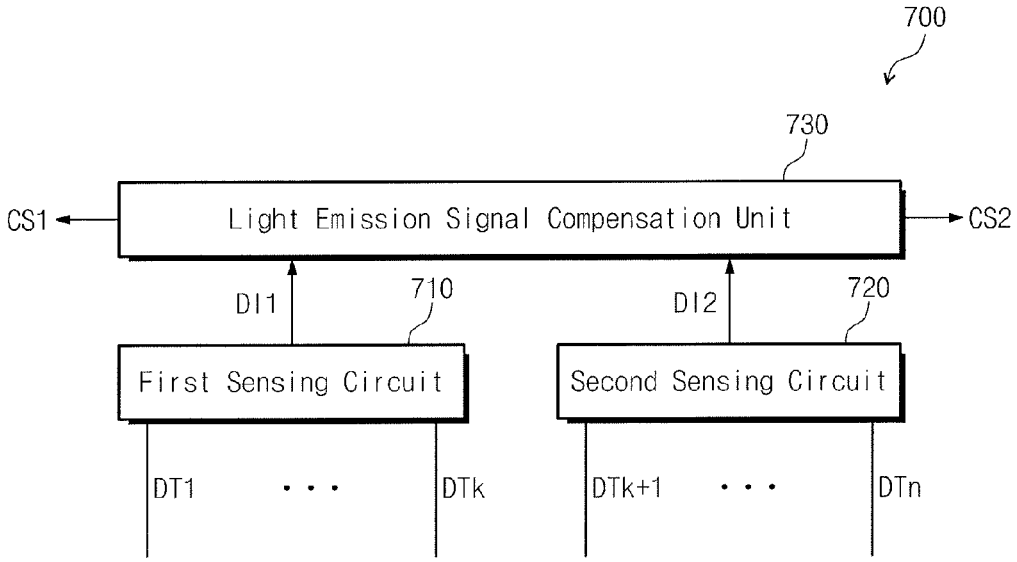
FIG. 6 illustrates an embodiment of a brightness compensation unit.

FIG. 6 illustrates an embodiment of the brightness compensation unit 700 which includes a first sensing circuit 710, a second sensing circuit 720, and a light emission signal compensation unit 730. The first sensing circuit 710 is connected to first detection lines DT1 to DTk among detection lines DT1 to DTn. The second sensing circuit 720 is connected to second detection lines DTk+1 to DTn among the detection lines DT1 to DTn. The first detection lines DT1 to DTk are connected to the first data lines D1 to Dk and the second detection lines DTk+1 to DTn are connected to the second data lines Dk+1 to Dn through the first switches SW1.

The first sensing circuit 710 provides detection current to first pixels through the first detection lines DT1 to DTk and the first data lines D1 to Dk, which are connected to each other. The first sensing circuit 710 detects a voltage applied to the light emission devices of the first pixels on the basis of the detection current through the first detection lines DT1 to DTk and the first data lines D1 to Dk, which are connected to each other. The first sensing circuit 710 provides voltage information of the first pixels, detected as first deterioration information DI1, to the light emission signal compensation unit 730.

The second sensing circuit 720 provides detection current to second pixels through the second detection lines DTk+1 to DTn and the second data lines Dk+1 to Dn, which are connected to each other. The second sensing circuit 720 detects a voltage applied to the light emission devices of the second pixels on the basis of the detection current through the second detection lines DTk+1 to DTn and the second data lines Dk+1 to Dn, which are connected to each other. The second sensing circuit 720 provides voltage information of the second pixels, detected as second deterioration information DI2, to the light emission signal compensation unit 730. Each of the first and second sensing circuits 710 and 720 may include, for example, a current source unit for generating and outputting detection current.

The light emission signal compensation unit 730 provides a first control signal CS1 for adjusting an applying time of a first light emission signal to the first light emission control driving unit 410 on the basis of the first deterioration information DI1. The light emission signal compensation unit 730 provides a second control signal CS2 for adjusting an applying time of a second light emission signal to the second light emission control driving unit 420 on the basis of second deterioration information DI2.

The light emission signal compensation unit 730 may include a look-up table to store the first and second deterioration information DI1 and DI2 and applying time data of the first and second light emission signals. The light emission signal compensation unit 730 may output the applying time data of the first and second light emission signals corresponding to the first and second deterioration information DI1 and DI2 using the lookup table.

Figure 7:
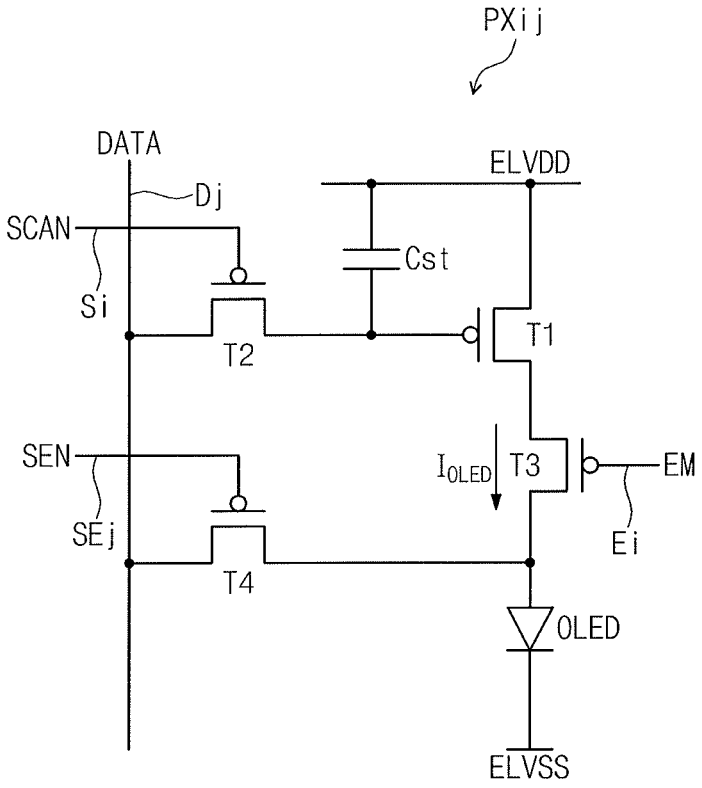
FIG. 7 illustrates an embodiment of a pixel in FIG. 4.
Figure 8:
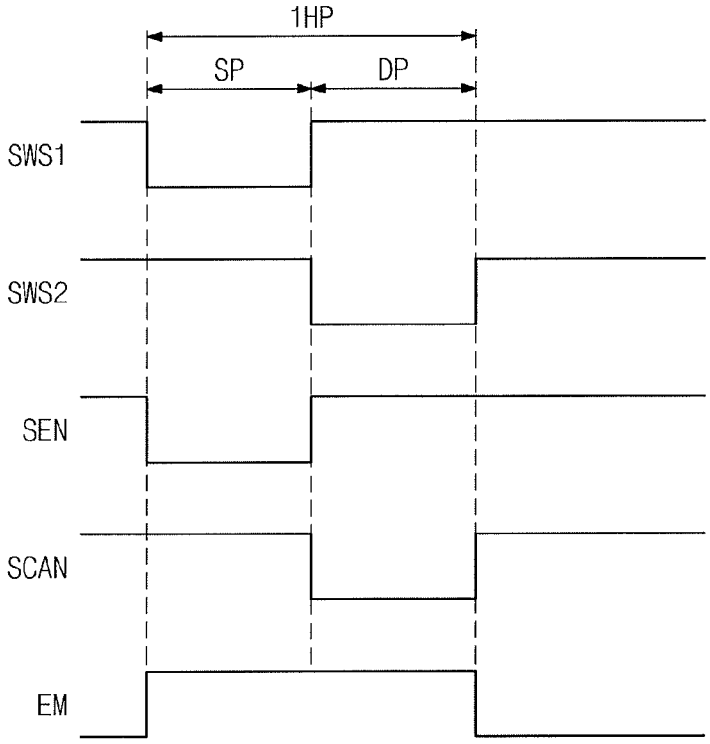
FIG. 8 illustrates an example of control signals for the pixel in FIG. 7.
Figure 9:
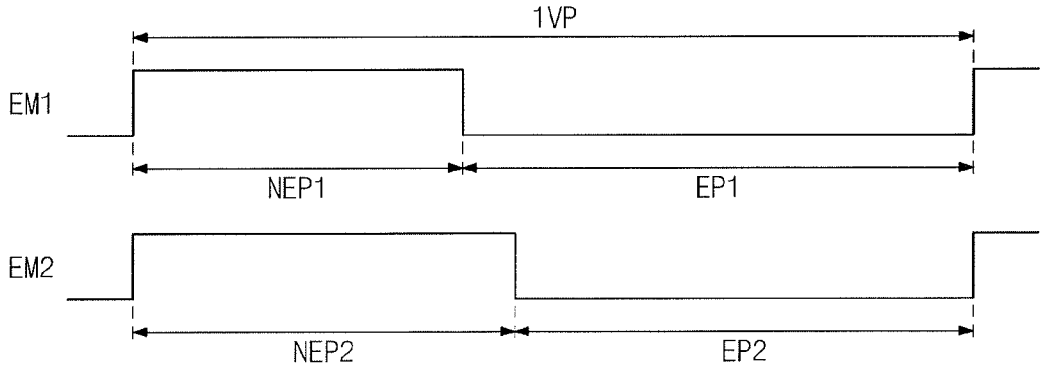
FIG. 9 illustrates examples of light emission signals for pixels that deteriorate at different rates.

FIG. 7 is an example of an equivalent circuit diagram of a pixel PXij in FIG. 4. FIG. 8 is a timing diagram of control signals for the pixel PXij in FIG. 7. FIG. 9 illustrates an example of the timing of a first light emission signal and a second light emission signal when first pixels have deteriorated to a greater degree than second pixels. The pixels PX11 to PXnm in FIG. 4 may have the same configuration and may operate in a same manner.

Referring to FIG. 7, a pixel PXij includes a light emission device OLED, a driving transistor T1, a capacitive device Cst, a switching transistor, T2, a light emission control transistor T3, and a sensing transistor T4.

The driving transistor T1 has a source terminal which receives a first voltage ELVDD and a drain terminal connected to the source terminal of the light emission control transistor T3. The gate terminal of the driving transistor T1 is connected to the drain terminal of the switching transistor T2.

The switching transistor T2 has a gate terminal connected to a corresponding scan line Si among scan lines S1 to Sm and a source terminal connected to a corresponding data lines Dj among data lines D1 to Dn.

The capacitive device Cst has a first electrode connected to the source terminal of the driving transistor T1 and a second electrode is connected to the gate terminal of the driving transistor T1.

The light emission control transistor T3 has a gate terminal connected to a corresponding light emission line Ei among first and second light emission lines E1_1 to E1_m and E2_1 to E2_m, and a drain terminal connected to an anode electrode of the light emission device OLED.

The light emission device OLED has a cathode electrode to receive a second voltage ELVSS. The second voltage ELVSS may have a lower level than the first voltage ELVDD.

The sensing transistor T4 has a gate terminal connected to a corresponding detection line SEj among detection lines SE1 to SEn, a source terminal connected to a corresponding data line Dj among the data lines D1 to Dn, and a drain terminal connected to the anode electrode of the light emission device OLED.

Referring to FIG. 8, one horizontal period 1HP includes a detection period SP and a driving period DP. During the detection period SP, a first switching signal SWS1 is applied to the first switches SW1. The first switches SW1 are turned on in response to the first switching signal SWS1 of a low level. Accordingly, the detection lines DT1 to DTn are connected to the data lines DL1 to DLn through the first switches SW1.

During the detection period SP, a detection signal SEN is applied to the detection line SEj. The sensing transistor T4 of the pixel PXij is turned on in response to the detection signal SEN received through the detection line SEj.

The first and second sensing circuits 710 and 720 apply detection current to the first and second pixels through the detection lines DT1 to DTn and the data lines D1 to Dn, which are connected to each other. The detection current is applied to the light emission devices OLED of the first and second pixels. In such a case, a predetermined voltage corresponding to the detection current is applied to the light emission device OLED of the pixel PXij.

The voltage applied to the light emission device OLED is changed in correspondence to the degree of deterioration of the light emission device OLED. For example, as the light emitting diode OLED deteriorates, the resistance value increases. In such a case, the voltage applied to the light emission device OLED changes based on the detection current in correspondence to the degree of deterioration in the light emission device OLED. Accordingly, the voltage of the light emission device OLED is a value that corresponds to deterioration information.

The first sensing circuit 710 detects a voltage of the light emission devices OLED of the first pixels and provides the detected voltage as first deterioration information DI1 to the light emission signal compensation unit 730. The second sensing circuit 720 detects a voltage of the light emission devices OLED of the second pixels and provides the detected voltage as second deterioration information DI2 to the light emission signal compensation unit 730.

As mentioned above, the light emission signal compensation unit 730 provides first and second control signals CS1 and CS2 to the first and second light emission control driving units 410 and 420 on the basis of the first and second deterioration information DI1 and DI2. The first and second light emission control driving units 410 and 420 adjust and output the applying time of the first and second light emission signals in response to the first and second control signals CS1 and CS2.

During the driving period DP, a second switching signal SWS2 is applied to the second switches SW2. The second switches SW2 are turned on in response to the second switching signal SWS2 of a low level. Accordingly, the driving lines DV1 to DVn are connected to the data lines D1 to Dn through the second switches SW2.

During the driving period DP, a scan signal SCAN is applied to a scan line Si. The switching transistor T2 of the pixel PXij is turned on in response to the scan signal SCAN received through the scan line Si.

The data driving unit 300 applies data voltages to the pixels PX11 to PXnm through the driving lines DV1 to DVn and the data lines D1 to Dn, which are connected to each other. The turned-on switching transistor T2 of the pixel PXij receives a data voltage through the data line Dj and applies the received data voltage to the gate terminal of the driving transistor T1.

The capacitive device Cst charges the data voltage applied to the gate terminal of the driving transistor T1 and maintains the data voltage after the switching transistor T2 is turned off. The driving period DP, in which the data voltage is maintained, may be defined as a data writing period.

During the detection period SP and the driving period DP, the light emission signal EM is a high level. The light emission control transistor T3 is turned off in response to the light emission signal EM of a high level. Since the light emission control transistor T3 is turned off, a driving current IOLED does not flow from the driving transistor T1 to the light emission device OLED. As a result, the light emission device OLED does not emit light.

Referring to FIG. 9, one vertical period 1VP includes non-light emission periods NEP1 and NEP2 and light emission periods EP1 and EP2. During the non-light emission periods NEP1 and NEP2, light emission signals EM1 and EM2 are a high level. During the light emission periods EP1 and EP2, the light emission signals EM1 and EM2 are a low level. The operations performed in the detection period and driving period of the non-light emission periods NEP1 and NEP2 may be as described above.

During the light emission periods EP1 and EP2, the light emission signals EM1 and EM2 are applied to the light emission lines E1_1 to E1_m and E2_1 to E2_m. During the light emission periods EP1 and EP2, the light emission signals EM1 and EM2 are a low level. The applying time of the light emission signals EM1 and EM2 may be substantially defined as a low level section of the light emission signals EM1 and EM2.

The light emission control transistor T3 of the pixel PXij is turned on in response to the light emission signals EM1 and EM2 received through the light emission line Ei. The turned-on light emission control transistor T3 serves to provide the current IOLED flowing in the driving transistor T1 to the light emitting diode OLED. Accordingly, the pixel PXij may emit light during an applying time of a light emission signal. The light emission device OLED emits light with a different intensity according to the amount of current IOLED received.

The transistors T1 to T4 of the pixel PXij may be PMOS transistors, NMOS transistors, or a combination thereof. When the transistors T1 to T4 are NMOS transistors, the levels of the signals in FIGS. 8 and 9 may be reversed.

The light emission signals EM1 and EM2 include a first light emission signal EM1 provided to the first pixels and a second light emission signal EM2 provided to the second pixels. A section of the first light emission signal EM1 includes a first non-light emission period NEP1 and a first light emission period EP1. A section of the second light emission signal EM2 includes a second non-light emission period NEP2 and a second light emission period EP2.

According to the degree of deterioration in the first pixels and the second pixels, the applying time of the first and second light emission signals EM1 and EM2 are adjusted differently. As a result, the light emission time of the first pixels and second pixels are adjusted differently. The applying times of the first and second light emission signals EM1 and EM2 are adjusted to allow the light emission time of pixels having a greater degree of deterioration, among the first and second pixels, to be longer than the light emission time having a lesser degree of deterioration.

For example, when the first pixels have deteriorated to a greater degree than the second pixels, as shown in FIG. 9, the first light emission period EP1 (e.g., the applying time of the first light emission signal EM1) is adjusted to be longer than the second light emission period IP2 (e.g., the applying time of the second light emission signal EM2). The low level section of the first light emission signal EM1 may be adjusted to be longer than a low level section of the second light emission signal EM2. As the light emission time of pixels becomes longer, the brightness of the pixels increases.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The drivers and controllers of the embodiments may be implemented in logic which, for example, may include hardware, software, or both. When implemented at least partially in hardware, the drivers and controllers may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the drivers and controllers may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, the display area of the panel may include first and second display areas. When unfolded, images are displayed on the entire display area. When folded, images may be displayed on only the first display area. Organic light emission devices in the first display area may deteriorate more quickly than those in the second display area. This is because the organic light emission devices in the first display area are used for a longer period of time, e.g., when the panel is both in folded and unfolded. Because the organic light emission devices deteriorate at different rates in the first and second display areas, images displayed on the entire display area when the panel is unfolded may have different brightness in the first and second display areas. Display quality may therefore be adversely affected.

In accordance with one or more of the aforementioned embodiments, the light emission time of the first pixels, which have a greater degree of deterioration, is adjusted to be longer than the light emission time of the second pixels, the difference between the brightness of the first display area DA1 and the brightness of the second display area DA2 may not be reduced or may not even be recognized. As a result, the display device 1000 and the corresponding driving method may improve brightness uniformity.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A display device, comprising:

a display panel including first pixels in a first display area and second pixels in a second display area;

a light emission control driver to control light emission times of the first and second pixels; and a brightness compensator to detect a degree of deterioration of the first pixels and a degree of deterioration of the second pixels, wherein the degree of deterioration of the first pixels is different from the degree of deterioration of the second pixels, and wherein the brightness compensator is to control the light emission control driver to set the light emission times of the first pixels to be different from the light emission times of the second pixels based on the different degrees of deterioration of the first and second pixels according to the adjustment of an applying time of at least one light emission signal, wherein an image is displayed in one of the first or second display areas when the display is folded, and an image is displayed on both of the first and second display areas when the display area is unfolded.

2. The device as claimed in claim 1, wherein:

a folding axis extends between the first and second display areas; and the display panel is to fold and unfold relative to the folding axis.

3. The device as claimed in claim 2, further comprising:

a plurality of scan lines extending in a first direction and connected to the first and second pixels, the scan lines to receive scan signals;

a plurality of data lines extending in a second direction intersecting the first direction and connected to the first and second pixels, the data lines to receive data voltages and detection currents;

a plurality of first light emission lines extending in the first direction and connected to the first pixels, the first light emission lines to receive first light emission signals from the light emission control driver;

a plurality of second light emission lines extending in the first direction and connected to the second pixels, the second light emission lines to receive second light emission signals from the light emission control driver; and a plurality of detection lines extending in the second direction and connected to the first and second pixels, the detection lines to receive detection signals.

4. The device as claimed in claim 3, wherein:

the first light emission lines are in the first display area and extend adjacent to the folding axis, and the second light emission lines are in the second display area and extend adjacent to the folding axis.

5. The device as claimed in claim 3, further comprising:

a scan driver to output the scan signals;

a data driver to output the data voltages during a driving period; and a switching circuit to connect the brightness compensator to the data lines during a detection period and to connect the data lines to the data driver during the driving period.

6. The device as claimed in claim 3, wherein the light emission control driver includes:

a first light emission control driver to output the first light emission signals; and a second light emission control driver to output the second light emission signals.

7. The device as claimed in claim 6, wherein:

during a detection period, the brightness compensator is to provide the detection currents to the first and second pixels and to detect the degrees of deterioration in the first and second pixels based on the detection currents;

during a driving period, the first and second pixels are to charge the data voltages based on the scan signals; and during a light emission period, the first and second pixels are to generate light corresponding to the data voltages based on the first and second light emission signals.

8. The device as claimed in claim 6, wherein the brightness compensator is to:

control the first light emission control driver to adjust applying times of the first light emission signals based on the degree of deterioration the first pixels, and control the second light emission control driver to adjust applying times of the second light emission signals based on the degree of deterioration of the second pixels.

9. The device as claimed in claim 8, wherein the applying times of the first and second light emission signals are to be adjusted to set the light emission times of the first pixels to be longer than the light emission times of the second pixels.

10. The device as claimed in claim 8, wherein the first and second pixels are to emit light during times that correspond to the applying times of the first and second light emission signals.

11. The device as claimed in claim 3, wherein each of the first and second pixels includes a light emitter to generate light based on a corresponding one of the data voltages.

12. The device as claimed in claim 11, wherein the brightness compensator includes:

a first sensing circuit to provide the detection currents to the first pixels during a detection period, detect one or more voltages applied to light emission devices of the first pixels based on the detection currents, and output the one or more detected voltages as first deterioration information;

a second sensing circuit to provide the detection currents to the second pixels during a detection period, detect one or more voltages applied to light emission devices of the second pixels based on the detection currents, and output the one or more detected voltages as second deterioration information; and a light emission signal compensator to output a first control signal corresponding to the first deterioration information and a second control signal corresponding to the second deterioration information.

13. The device as claimed in claim 12, wherein:

the first light emission control driver is to adjust and output an applying time of the first light emission signal based on the first control signal, and the second light emission control driver to adjust and output an applying time of the second light emission signal based on the second control signal.

14. The device as claimed in claim 1, wherein the display panel is a flexible display panel.

15. A driving method of a display device, the method comprising:

applying detection currents to light emission devices of first pixels in a first display area of a display panel and to light emission devices of second pixels in a second display area of the display panel;

detecting different degrees of deterioration of the first pixels and the second pixels based on the detection currents; and adjusting light emission times of the first pixels based on the degree of deterioration of the first pixels and the light emission times of the second pixels based on degree of deterioration of the second pixels, the first and second pixels to emit light according to the adjusted light emission times, the light emission times of the first pixels and the light emission times of the second pixels adjusted differently based on the different degrees of deterioration of the first and second pixels according to the adjustment of an applying time of at least one light emission signal, wherein an image is displayed in one of the first or second display areas when the display is folded, and an image is displayed on both of the first and second display areas when the display area is unfolded.

16. The method as claimed in claim 15, wherein:

the degree of deterioration of the first pixels is greater than the degree of deterioration of the second pixels, and the light emission times of the first pixels are longer than the light emission times of the second pixels.

17. The method as claimed in claim 15, wherein detecting the degrees of deterioration of the first and second pixels includes:

detecting one or more voltages applied to light emitters of the first pixels based on the detection currents and outputting the one or more detected voltages as first deterioration information;

detecting one or more voltages applied to light emitters of the second pixels based on the detection currents, and outputting the one or more detected voltages as second deterioration information; and adjusting applying times of first light emission signals for the first pixels based on the first deterioration information and applying times of second light emission signals for the second pixels based on the second deterioration information.

18. The method as claimed in claim 17, wherein the first and second pixels generate light corresponding to data voltages received in response to scan signals and emit light during times corresponding to the applying times of the first and second light emission signals.

19. The method as claimed in claim 15, wherein:

the display panel is a flexible display panel;

a folding axis is between the first and second display areas;

images are displayed in one of the first or second display area when the display panel is folded; and images are displayed in both of the first and second display areas when the display panel is unfolded.

* * * * *